US010246914B2

(12) United States Patent
Sieglaar et al.

(10) Patent No.: US 10,246,914 B2
(45) Date of Patent: Apr. 2, 2019

(54) TWO POINT LOCK FOR BI-FOLD WINDOWS AND DOORS

(75) Inventors: Edward Norton Sieglaar, Auckland (NZ); Cristina Roman, Auckland (NZ)

(73) Assignee: Schlage Lock Company LLC, Carmel, IN (US)

( * ) Notice: Subject to any disclaimer, the term of this patent is extended or adjusted under 35 U.S.C. 154(b) by 375 days.

(21) Appl. No.: 14/387,077

(22) PCT Filed: Mar. 21, 2012

(86) PCT No.: PCT/US2012/029949

§ 371 (c)(1), (2), (4) Date: May 18, 2015

(87) PCT Pub. No.: WO2013/141856

PCT Pub. Date: Sep. 26, 2013

(65) Prior Publication Data

US 2015/0252598 A1 Sep. 10, 2015

(51) Int. Cl.
*E05C 5/02* (2006.01)
*E05C 1/00* (2006.01)
(Continued)

(52) U.S. Cl.
CPC ..... *E05C 1/08* (2013.01); *E05B 15/0053* (2013.01); *E05B 17/2038* (2013.01);
(Continued)

(58) Field of Classification Search
CPC ... E05C 1/08; E05C 1/002; E05C 1/10; E05C 3/12; E05C 3/124; E05C 9/043; E05C 1/085; E05C 9/002; Y10T 292/0802; Y10T 292/0844; Y10T 292/0962; E05B 15/0053; E05B 17/2038; E05B 61/00; E05B 65/0085; E05B 63/202; E05B 63/20; E05B 17/0037; E05B 15/04; E05B 15/101
(Continued)

(56) References Cited

U.S. PATENT DOCUMENTS 129,052 A * 7/1872 Pigot ..... E05B 65/0075 70/118
140,307 A * 6/1873 Rand ..... E05C 9/043 292/36
(Continued)

OTHER PUBLICATIONS

International Search Report and Written Opinion; dated Apr. 1, 2013; PCT Application No. PCT/US12/29949; pp. 1-9; International Searching Authority.

*Primary Examiner* — Kristina R Fulton
*Assistant Examiner* — Faria F Ahmad
(74) *Attorney, Agent, or Firm* — Taft Stettinius & Hollister LLP

(57) ABSTRACT

A two point lock for securing bi-folding windows and doors in which upper and lower shoot bolt arms move in opposite directions from a central lock body upon rotation of a handle. When the arms are in their mutually extended positions, a sliding detent locking member engages the upper shoot bolt arm to secure the window or door in the closed position. The central lock body includes a rotating driver for the shoot bolt arms that is supported at both ends and is maintained in two different positions by interaction with the curved contact faces of a set of biasing pads.

25 Claims, 4 Drawing Sheets

(51) Int. Cl.

| | |
|---|---|
| ***E05C 1/08*** | (2006.01) |
| ***E05B 17/20*** | (2006.01) |
| ***E05B 65/00*** | (2006.01) |
| ***E05C 9/04*** | (2006.01) |
| ***E05B 15/00*** | (2006.01) |
| ***E05B 61/00*** | (2006.01) |
| ***E05C 1/10*** | (2006.01) |
| ***E05C 3/12*** | (2006.01) |
| *E05C 1/06* | (2006.01) |
| *E05C 1/12* | (2006.01) |
| *E05C 9/00* | (2006.01) |
| *E05C 9/10* | (2006.01) |
| *E05C 1/02* | (2006.01) |
| *E05B 15/04* | (2006.01) |

(52) U.S. Cl.

CPC ..... *E05B 61/00* (2013.01); *E05B 65/0085* (2013.01); *E05C 1/002* (2013.01); *E05C 1/10* (2013.01); *E05C 3/12* (2013.01); *E05C 3/124* (2013.01); *E05C 9/043* (2013.01); *E05B 15/04* (2013.01); *Y10T 292/0802* (2015.04); *Y10T 292/0844* (2015.04); *Y10T 292/0962* (2015.04)

(58) Field of Classification Search

USPC .. 292/4, 32, 37, 137, 157, 159, 197, 40, 42, 292/44–50, 54, 161, 163, 164, 165, 169, 292/332, 31, 34, DIG. 52; 70/107–111

See application file for complete search history.

(56) References Cited

U.S. PATENT DOCUMENTS 419,903 A * 1/1890 Wilkins ..... E05B 63/20 292/39
519,687 A * 5/1894 Johnston ..... E05B 63/20 292/39
660,403 A * 10/1900 Sutton ..... E05B 63/20 292/39
958,880 A * 5/1910 Lawson ..... E05B 63/20 292/32
981,843 A * 1/1911 Davis ..... E05B 65/5238 292/41
1,071,656 A * 8/1913 Voight ..... E05B 63/20 292/193
1,124,821 A * 1/1915 Smolensky ..... E05C 9/02 292/45
1,195,594 A * 8/1916 Kohut ..... E05B 63/20 292/39
1,324,181 A * 12/1919 Smith ..... E05B 63/20 292/336
1,346,143 A * 7/1920 Teich ..... E05B 63/20 292/DIG. 21
1,395,688 A * 11/1921 Mcculloch ..... E05C 9/02 292/37
1,438,547 A * 12/1922 O'connor ..... E05B 65/025 217/65
1,469,590 A * 10/1923 Palmer ..... E05B 63/20 292/196
1,573,653 A * 2/1926 Stewart ..... E05B 63/20 292/335
1,721,489 A * 7/1929 Prinzler ..... E05B 65/1006 292/21
1,777,176 A * 9/1930 Mcody ..... E05C 9/02 292/223
1,909,697 A * 5/1933 MacBeth ..... E05B 13/004 292/150
2,349,192 A * 5/1944 Oxhandler ..... E05B 5/003 70/208
2,406,459 A * 8/1946 Gibson ..... E05C 9/04 292/39
2,486,586 A * 11/1949 Brittain ..... E05B 5/003 292/1
2,729,089 A * 1/1956 Pelcin ..... E05B 47/0002 292/36
2,739,471 A * 3/1956 Cook ..... E05C 9/02 70/120
2,787,154 A * 4/1957 Wesberry ..... E05C 9/041 292/39
3,083,560 A * 4/1963 Scott ..... E05B 65/1066 292/21
3,214,947 A * 11/1965 Wikkerink ..... E05B 65/1066 292/92
3,328,060 A * 6/1967 Soderberg ..... E05C 9/002 292/216
3,334,500 A * 8/1967 Bejarano ..... E05B 63/20 292/21
3,953,061 A * 4/1976 Hansen ..... E05C 9/002 292/5
4,021,065 A * 5/1977 Geringer ..... E05B 47/0002 292/144
4,130,306 A * 12/1978 Brkic ..... E05B 65/1053 292/21
4,146,994 A * 4/1979 Williams ..... E05B 63/20 49/367
4,263,795 A * 4/1981 Van Gompel ..... E05C 1/08 292/167
4,265,051 A * 5/1981 Williams ..... E05F 5/12 49/367
4,283,882 A * 8/1981 Hubbard ..... E05B 63/20 292/18
4,362,328 A * 12/1982 Tacheny ..... E05C 9/043 292/36
4,387,917 A * 6/1983 Cocker ..... E05B 63/20 292/40
4,470,277 A * 9/1984 Uyeda ..... E05B 65/0075 292/34
4,641,865 A * 2/1987 Pastva ..... E05B 63/0069 292/5
4,892,338 A * 1/1990 Weinerman ..... E05C 9/046 292/166
4,951,486 A * 8/1990 Braun ..... E05C 9/046 292/DIG. 31
4,973,091 A * 11/1990 Paulson ..... E05C 9/041 292/216
5,114,192 A * 5/1992 Toledo ..... E05B 63/20 292/21
5,154,454 A * 10/1992 Hollaway ..... E05B 65/1046 292/21
5,487,289 A * 1/1996 Otto, III ..... E05B 47/0002 292/150
5,595,076 A * 1/1997 Weinerman ..... E05B 5/00 292/34
5,722,704 A * 3/1998 Chaput ..... E05B 65/0811 292/26
5,791,700 A * 8/1998 Biro ..... E05C 9/043 292/36
5,816,017 A * 10/1998 Hunt ..... E05B 65/1046 52/784.11
5,911,763 A * 6/1999 Quesada ..... E05C 9/043 292/36
5,915,764 A 6/1999 MacDonald
6,250,015 B1 * 6/2001 Gillispie ..... B01L 1/50 312/324
6,490,895 B1 * 12/2002 Weinerman ..... E05B 5/00 292/166
6,945,571 B2 * 9/2005 Lin ..... E05B 65/1013 292/156
6,971,686 B2 * 12/2005 Becken ..... E05B 63/20 292/142
7,040,675 B1 * 5/2006 Ott ..... B60J 7/19 292/123
8,250,888 B2 * 8/2012 Agazzi ..... E05B 13/103 292/336.3
8,276,527 B2 * 10/2012 Stepp ..... E05B 65/0075 109/59 R

(56) References Cited

U.S. PATENT DOCUMENTS

| | | | | |
|---|---|---|---|---|
| 8,347,665 | B2 * | 1/2013 | Rasmussen | E05B 47/0673 109/59 R |
| 8,398,126 | B2 * | 3/2013 | Nakanishi | E05B 63/185 292/1.5 |
| 8,550,506 | B2 * | 10/2013 | Nakanishi | E05B 63/185 292/162 |
| 8,657,345 | B1 * | 2/2014 | Shih | E05C 7/00 292/32 |
| 8,899,635 | B2 * | 12/2014 | Nakanishi | E05B 63/0056 292/194 |
| 9,074,392 | B2 * | 7/2015 | Berger | E05B 53/003 |
| 9,428,940 | B1 * | 8/2016 | Patrick | E05B 63/14 |
| 9,630,036 | B2 * | 4/2017 | Strum | A62C 2/242 |
| 2004/0066046 | A1 * | 4/2004 | Becken | E05B 63/20 292/39 |
| 2010/0117380 | A1 * | 5/2010 | Agazzi | E05B 13/103 292/336.3 |
| 2012/0137742 | A1 * | 6/2012 | Isley | E05B 59/00 70/124 |
| 2012/0139266 | A1 * | 6/2012 | Chen | E05B 63/20 292/8 |
| 2013/0193818 | A1 * | 8/2013 | Sturm | A62C 2/242 312/222 |
| 2015/0008680 | A1 * | 1/2015 | Suzuki | B60R 7/06 292/32 |
| 2016/0244993 | A1 * | 8/2016 | Nepsha | E05B 15/00 |

* cited by examiner

TWO POINT LOCK FOR BI-FOLD WINDOWS AND DOORS

The present application is a U.S. National Phase of International PCT Application No. PCT/US2012/029949 filed on Mar. 21, 2012, the contents of which are herby incorporated by reference in their entirety.

TECHNICAL FIELD

The present invention relates to locks which use shoot bolts to secure a window or door in its closed position, and more particularly, but not exclusively, to a two point lock for use in bi-fold windows and doors.

BACKGROUND

A bi-fold door is a type of sliding door that has multiple hinged sections that fold together as the door is opened, and thus it is conventionally locked by way of vertical shoot bolts that project from the door into the surrounding frame so as to anchor the door at its top and bottom. The shoot bolts are typically connected by rods to shoot bolt arms of a central lock, and the shoot bolt arms are operatively coupled to a rotating driver so as to be moved linearly in opposite directions as the driver rotates. The rotating driver is typically provided as a follower to the spindle of a lever style handle, and thus when the handle is in one orientation (e.g. horizontal) the shoot bolts are fully retracted and when the handle is in another orientation (e.g. vertical) the shoot bolts are fully extended.

In the bi-fold door lock marketed by Assa Abloy Australia Pty Limited (Sherwood QLD) as the TWIN BOLT LOCK, the spindle follower is rotatably mounted in one side of the lock casing and a tensioning disk is mounted at the other end of the spindle follower. The tensioning disk has four flattened sections that interact with the flat interior side walls of the lock casing to bias the follower towards two different home positions corresponding to the shoot bolts being either fully extended or fully retracted. The rotation of the spindle follower is converted to opposite linear motion of the shoot bolt arms by way of a planetary gear system, i.e. the spindle follower is the central gear and each shoot bolt arm is pivotably linked to a respective satellite gear. And for applications requiring additional security, deadlocking is provided by using a key cylinder to press a locking plate into engagement with the follower, thereby preventing the follower from rotating.

While a bi-fold style lock can generally be employed in other types of doors, such as in the secondary door of a set of French doors, there are unique challenges to meeting the demands of bi-fold doors. This is because in most bi-fold doors applications, it is desirable to have the handle mounted on only one side of the door (the interior side) in order to leave the other side (the exterior side) unobstructed. This allows the sections to lay flat against each other when the door is fully opened, but it also results in the exterior end of the spindle being unsupported. Thus, as one pulls on the lever handle to open a bi-fold door, there can be a tendency for the spindle to move or shift within the lock.

As present bi-fold lock designs suffer from a variety of drawbacks, limitations, disadvantages and problems, there is need for improvement in the art.

SUMMARY

According to one aspect, a unique bi-fold lock is provided in which the shoot bolts can be locked in their extended position in more secure manner so as to be resistant to being overcome by force. According to another aspect, a unique bi-fold lock is provided in which the handle in more securely maintained in its two different rest positions. Accordingly to another aspect, a unique bi-fold lock is provided in which the shoot bolt driving mechanism is simple in design and construction. According to another aspect, a unique bi-fold lock is provided in which the shoot bolt driving mechanism can better tolerate or prevent shifting of the spindle. Further embodiments, forms, features, aspects, benefits, and advantages of the present application shall become apparent from the description and figures provided herewith.

BRIEF DESCRIPTION OF THE FIGURES

Features of the invention will be better understood from the following detailed description when considered in reference to the accompanying drawings, in which.

DETAILED DESCRIPTION OF THE ILLUSTRATIVE EMBODIMENT

Figure 1:
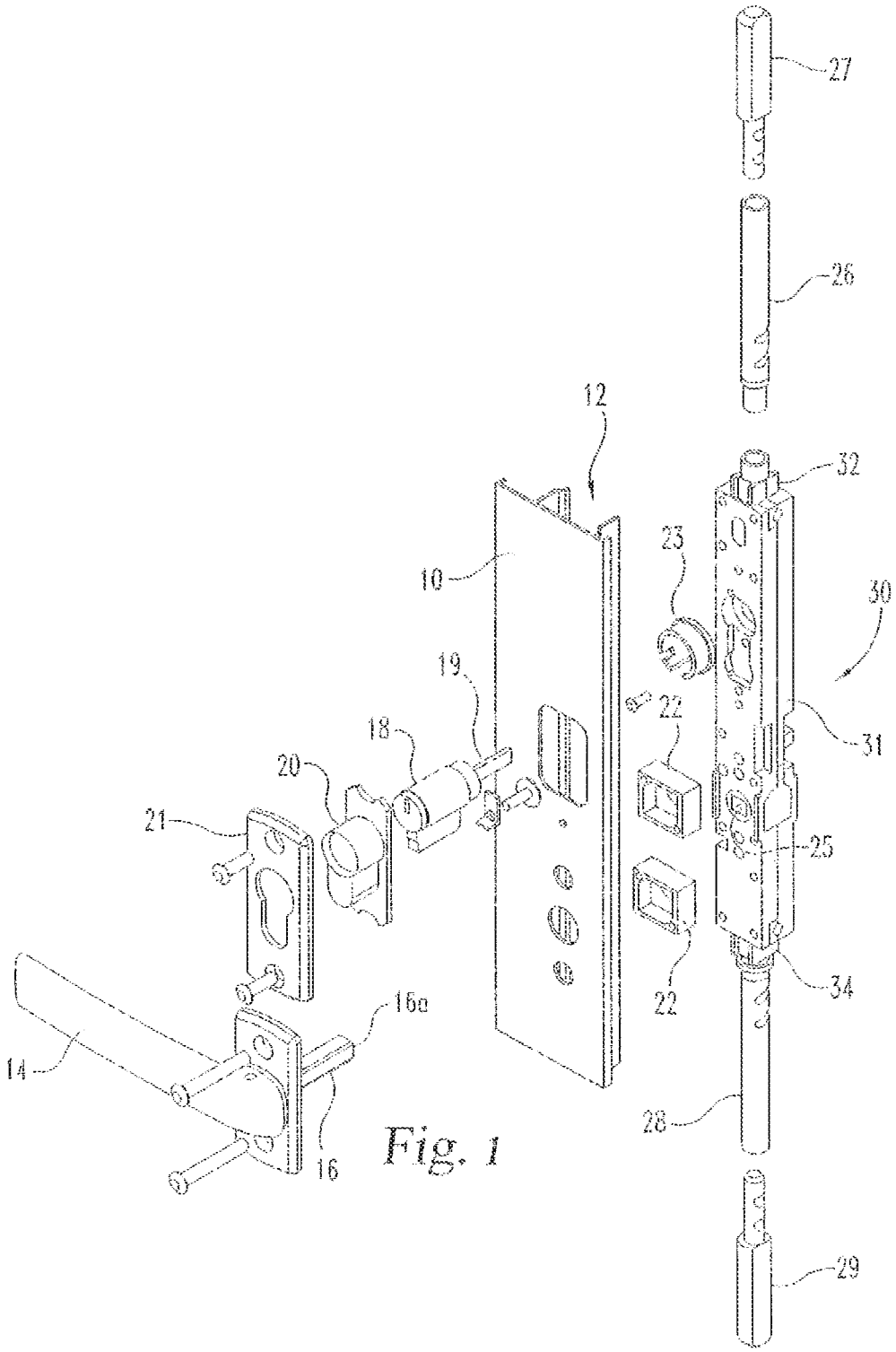
FIG. 1 is an exploded view of a two point lock according to one embodiment installed in a conventional bi-fold door.

While the present invention can take many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments and any further applications of the principles of the invention as described herein are contemplated as would normally occur to one skilled in the art to which the invention relates.

With reference to the Figures, two point lock 30 is designed to be embedded within the stile 10 of a conventional bi-fold window or door. The lock 30 is mounted within the stile 10 in a manner that is generally similar to known locks, and thus only a representative section of the stile 10 is shown in FIG. 1.

The central lock 30 is positioned in the hollow cavity 12 that extends the length of stile 10 with appropriately sized packers 22 clipped to casing 31 to position the lock at the appropriate depth within the cavity 12. Upper and lower connecting rods 26, 28 are screwed into the ends of the corresponding shoot bolts bolt arms 32 and 34 and, after the rods are cut to the appropriate length, D shaped tips 27, 29 are crimped in the ends of the connecting rods 26, 28.

The spindle 16 of the lever style handle 14 extends through the stile 10 and through the correspondingly shaped opening 25 in lock 30. The end 16*a* of spindle extends entirely through the lock 30 but not into the exterior face of the stile (not shown), because in the illustrated embodiment, there is no corresponding handle on the exterior face to receive and support the end 16*a* of spindle 16. The two mounting screws for the handle escutcheon extend through the corresponding holes in the stile 10 and the packers 22 and into threaded mounting holes 71, 73, that extend entirely through lock casing 31, and tightening of these mounting screws serves to secure the lock 30 in position.

Key cylinder 18 is secured within its housing 20 with a retainer and wafer screw, and the assembly is then placed through the rectangular shaped opening and lock cylinder locator 23 so as to have cylinder tail 19 extending through rectangular opening in locking cam 54. Key cylinder escutcheon 21 is secured to frame 10 to retain the key cylinder assembly in place and cover the opening.

To further secure the lock 30 within the stile, additional screws (not shown) may be inserted through the side of the stile into the side mounting holes provided near the upper and lower ends of the casing 31. In other embodiments, the lock 30 may be configured as a mortise style lock.

Figure 2:
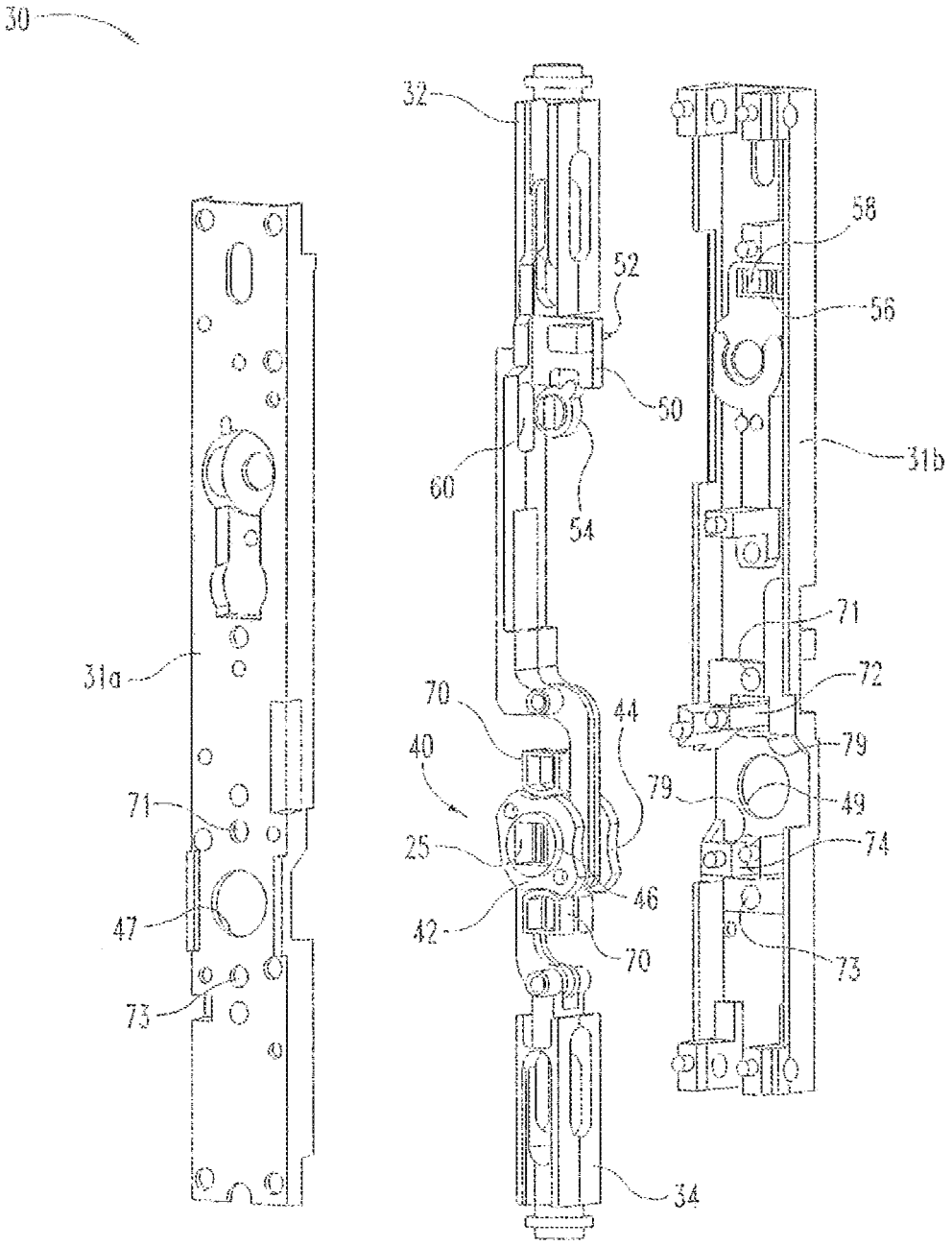
FIG. 2 is an exploded view of the lock of FIG. 1.
Figure 3:
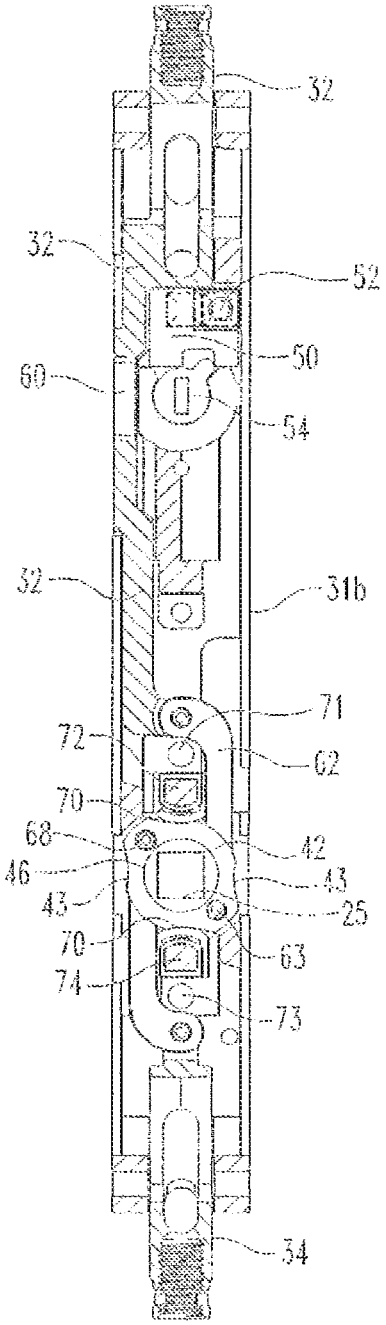
FIG. 3 is an elevational view in partial section showing the FIG. 1 lock in an unlocked configuration with the shoot bolt arms retracted.
Figure 4:
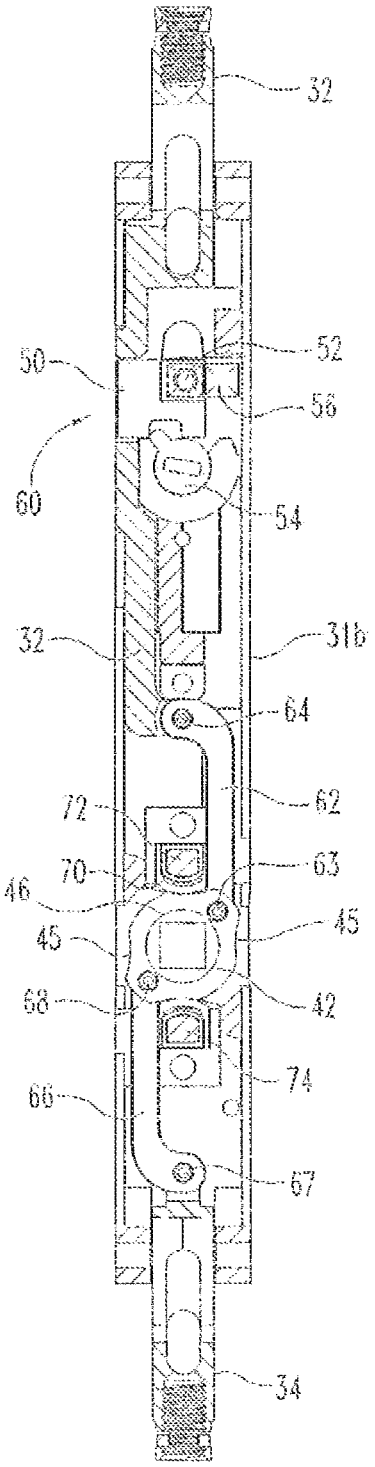
FIG. 4 is an elevational view in partial section showing the FIG. 1 lock in a locked configuration with the shoot bolt arms extended.

With reference to FIGS. 2-4, spindle 16 extends through the central bore of a shoot bolt driver 40 that is shaped such that it rotates with the spindle 16 in a follower arrangement. The driver 40 is composed of two spindle followers 42 and 44 that are of identical construction and are coupled together by pins 63 and 68, which serve to pivotably connect the assembly to upper and lower linkage arms 62, 66. Follower 42 has a rounder shoulder portion 46 that is rotatable supported in the rounded opening 47 in casing 31*a*, and the corresponding shoulder portion (not shown) on follower 44 is identically supported in opening 49 of casing 31*b*. Thus, the driver 40 is supported in the casing 31 at both of its ends, which enhances its stability.

The upper and lower shoot bolt arms 32 and 34 are contained within casing 31 so as to be slidable along the longitudinal axis of lock, which corresponds to the vertical direction. The other end of the upper linkage arm 62 is pivotably coupled to upper shoot bolt arm 32 with pin 64, and the other end of lower linkage arm 66 is pivotably coupled to lower shoot bolt arm 34 with pin 67.

In operation, as the driver 40 rotates counter clockwise as viewed in FIG. 3, which corresponds to the lever handle 14 rotating downward as seen in FIG. 1, the upper shoot bolt arm 32 slides upward and the lower shoot bolt arm 34 slides downward until the mutually extended position of FIG. 4 is reached. Rotation of the handle 14 in the opposite direction reverses the process and moves the shoot bolt arms from the mutually extended position of FIG. 4 to the mutually retracted position of FIG. 3.

In both the mutually extended and mutually retracted configurations, the follower 44 contacts the inwardly projecting lips 79 provided on casing 31*b* above and below opening 49 (see FIG. 2) and follower 42 contacts corresponding lips (not shown) on casing 31*a*. The contact of the followers 42, 44 with the casing lips serves as a positive stop to the driver 40 and helps to assure that any additional rotational force applied to the lever is transferred to the casing 31*a* and 31*b*, thus protecting the internal lock components.

In the illustrated embodiment, each shoot bolt arm is coupled to an opposing portions of a common driver by way of a single pivoting linkage, which is an efficient design that allows the size of the lock 30 to be reduced. Further, because the shoot bolt arms 32, 34, linkages 62, 66, and driver 40 can be pre assembled as an integrated assembly, overall assembly of the lock 30 can be made more efficient or reliable.

In other embodiments, the shoot bolts arms may be moved in opposite directions by other means know in the art. For example, rather than having both linkages 62, 66 coupled to a common driver 40 so as to move the same extent, one of the spindle hubs 42, 44 can be converted to a planetary gear with one or both of the linkages 62, 66 coupled to a satellite gear. Alternatively, in place of pivotable linkages 62, 66, connecting the shoot bolt arms 32, 34 to the driver 40, the shoot bolt arms can be directly coupled to the driver 40, for example, with a driver pin riding in a slot on the shoot bolt arm.

Locking member 50 is slideable within casing and is constrained to move in a horizontal path as viewed in FIGS. 3 and 4 by a guiding slot (not shown) formed in lock casing 31*a* and guiding features in the lock casing 31*b*. The locking member 50 is moved between the unlocked position shown in FIG. 3 and the locked position shown in FIG. 4 by cylinder cam 54, which is actuated by key cylinder 18.

A spring biased plunger 52 is carried within locking member 50 so as to have an operating stroke into the page as viewed in FIGS. 3 and 4. The plunger 52 engages in corresponding recesses 56, 58 in casing 31*b* and serves to yielding bias the locking member 50 to be in either the locked or unlocked position.

When in the locked position, locking member 50 is received in the longitudinally elongated slot 60 that extends entirely through the upper shoot bolt arm 32. Accordingly, when the locking member 50 is engaged in slot 60 of upper shoot bolt arm 32, retraction of the shoot bolts is prevented. Moreover, if a vandal were to apply a large torque to the handle 14 in an effort to force the lock open, the upper shoot bolt arm 32 can be made to remain locked, and either pin 64 or 63 can be made to break. Thus, while forcing the handle 14 would allow the lower shoot bolt to be withdraw, the upper shoot bolt would remain engage to keep the door secured. Accordingly, the provision of locking member 50 engaging with the upper shoot bolt arm 32 can serve to make the lock more secure against vandals.

In other embodiments, lock 30 may be provided without locking member 50, or locking member 50 may be adapted to directly engage the driver 40.

The outer radial surface of each of the followers 42, 44 are provided with recess 43 and 45 that interact with the curved contacting faces 78 of biasing pads 70 to bias the driver 40 towards stable rest positions. These rest positions correspond to the shoot bolt arms being either fully extended, which is the configuration shown in FIG. 4, or fully retracted, which is the configuration shown in FIG. 3. It is to be understood that a rest position is a position whereby the driver rests against the contact face of the biasing pad 70 in a stable manner (i.e. where the forces applied by the contact face to the driver are balanced so that no moment is created to rotate the driver.) In contrast, when the driver is moved away from a rest position, the contact face of the biasing pad 70 pushes back against the driver 40 so as to create a restoring moment that tends to urge the driver 40 to rotate into one of its stable rest position, though the moment created may or may not be of sufficient magnitude to overcome, for example, the friction related to the shoot bolts entering their respective strikers.

Figure 5:
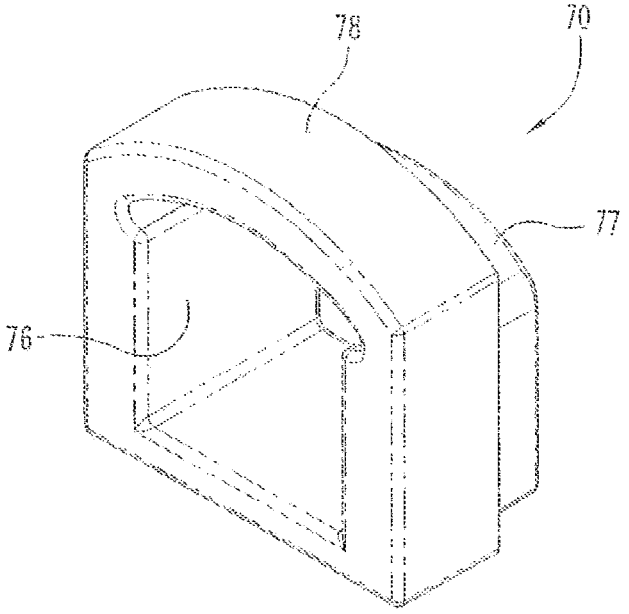
FIG. 5 is an perspective view of one of the biasing pads used in the FIG. 1 lock.
Figure 6:
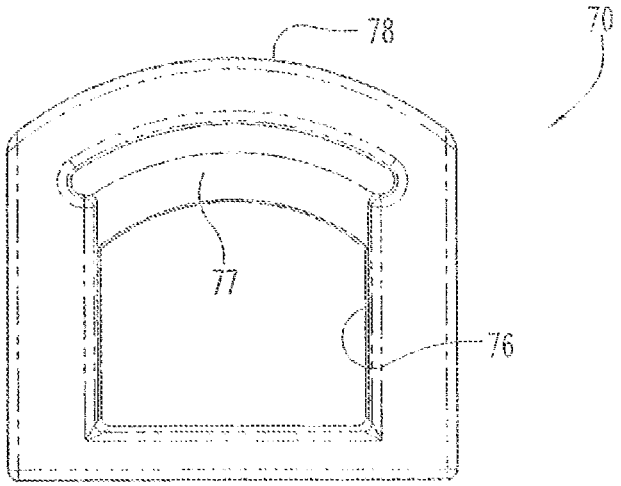
FIG. 6 is an elevational view of the biasing pad of FIG. 5.

The biasing pads 70 are made of a hard synthetic material, such as nylon, and are secured to mounting posts 72, 74 which extend from lock casing 31*b* in directions parallel to the axis of the driver 40. More specifically, as shown in FIGS. 5 and 6, each pad 70 has a main body portion or base 77 having a through hole 76 that is shaped like the mounting posts 72 or 74, and each pad 70 has a contacting face 78 that is provided on an arm that is both longitudinally offset from the base 77 and spaced from the base (as viewed in FIG. 6). Two pads 70 are mounted on the upper mounting post 72 and two pads are mounted on the lower mounting post 74 with the bases 77 in each pair adjacent to each other. As a result, the contact faces 78 for one set of the pads 70 are at opposing radial positions relative to follower 42 and the contact faces 78 for another set of the pads 70 are at opposing radial positions relative to with follower 44. The provision of multiple contacting faces 78 interacting with the rotating driver 40 at different points along the axis of the driver 40 and from multiple sides at a single location enhances the stability of lock 30 and serves to reduce the chance that the shoot bolts will be improperly positioned.

In operation, as the driver 40 rotates away from either the home position shown in FIG. 3 or the home position of FIG. 4, the contact face 78 of each pad 70 must compresses or deflect inwardly towards the respective mounting post, which allows for the storage of considerable potential energy in the pad 70, and the release of the stored energy can be sufficient to rotate the driver 40 to one of the home positions.

As is to be appreciated, what has been described includes a novel two point lock for securing bi-fold windows and doors comprising a central lock body, a handle that is rotatable with respect to the lock body between a first rest position and a second rest position, first and second shoot bolt arms that move in opposite directions upon rotation of the handle and are maintained in a mutually retracted position when the handle is in the first rest position and in a mutually extended position when the handle is in the second rest position, a locking member moveable within the casing between a locked position, in which the locking member is engaged with the first shoot bolt arm in its extended position, and an unlocked position, in which the locking member is unengaged with the first shoot bolt arm, and, an actuator, such as would be operated by a key, for moving the locking member between its locked and unlocked positions when the shoot bolt arms are in their mutually extended position. The locking member may be slideable within the housing and yielding biased to remain in at least one of the locked and the unlocked position, which may be accomplished by the provision of at least one spring biased plunger which may operate in a direction normal to the direction of travel of the locking member. The locking member may engage in a locking slot of the first shoot bolt arm, and that slot may correspond in size to the locking member, for example with both being elongated in the direction of travel of the first shoot bolt arm. The locking slot may extend entirely through the first shoot bolt arm.

The motion of the shoot bolt arms may be linked to the rotation of the handle in a number of ways known in the art. In one preferred form, each shoot bolt arm is coupled to a rotating driver by way of a linkage arm that is pivotably coupled to the driver and to the shoot bolt arm. Individual drivers for each arm may be operated from a central hub, or each shoot bolt arm may be coupled to opposing portions of the same rotating driver. The rotating driver may be rotatably supported in the lock body at two different locations along the rotation axis of the driver.

The lock body may include at least one spindle follower that rotates with the handle and at least one biasing device that interacts with the spindle follower to maintain the handle in the first and second rest positions. The biasing device may comprise a plurality of biasing pads having curved contact faces that engage with corresponding recesses in the spindle follower.

What has also been described is a novel two point lock for securing bi-fold windows and doors comprising a central lock body, a driver contained within the body so as to be rotatable by a handle, a plurality of biasing pads having curved contact faces that engage with recess in radial surfaces of the driver to maintain the driver in a first rest position and a second rest position, and first and second shoot bolt arms that move in opposite directions upon rotation of the driver and are maintained in a mutually retracted position when the driver is in the first rest position and in a mutually extended position when the driver is in the second rest position. Each biasing pad may include a body portion and an arm spaced from the body portion. The body portion may be mounted on a post and the arm may be made to deflect towards the post as the driver is rotated between the first rest position and the second rest position. The driver is rotatably supported in the lock body at two different locations along the rotation axis of the driver. The biasing pads may contact the driver at different locations along the rotation axis of the driver and/or at opposing radial positions. The lock may further include a locking member for selectively locking the shoot bolts in their mutually extended position, for example, one that is selectively engageable with the first shoot bolt arm.

What is also described is a two point lock for securing bi-fold windows and doors comprising a central lock body, a driver rotatably supported in the lock body at two different locations along the rotation axis of the driver, at least one biasing pad that interacts with the driver to maintain the driver in a first rest position and a second rest position, and first and second shoot bolt arms that move in opposite directions upon rotation of the driver and are maintained in a mutually retracted position when the driver is in the first rest position and in a mutually extended position when the driver is in the second rest position. The biasing pads may have curved contact faces that engages with recesses in the driver. A plurality of biasing pads contact the driver at different locations along the rotation axis of the driver, and/or at opposing radial positions. The lock body may include a first set of stops which contact the driver in the first position so as to prevent further rotation of the driver in a first direction and/or a second set of stops which contact the driver in the second position so as to prevent further rotation of the driver in a second direction.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A two point lock for bi-fold windows and doors, comprising:

a central lock body comprising a casing;

a handle that is rotatable with respect to the lock body between a first rest position and a second rest position;

a rotating driver coupled to the handle for rotation therewith, the driver including a pair of opposing members having a gap defined therebetween;

first and second shoot bolt arms that move in opposite directions upon rotation of the handle and are maintained in a mutually retracted position when the handle is in the first rest position and in a mutually extended position when the handle is in the second rest position, and wherein each of the first and second shoot bolt arms extends into the gap, a portion of each of the first and second shoot bolt arms that is positioned within the gap between the pair of opposing members being rotably displaceable within the gap via rotation of the driver and pivotably connected to the driver through a corresponding pivot, each pivot having a first end supported by one of the opposing members and an opposite second end supported by the other of the opposing members;

a locking member moveable within the casing between a locked position in which the locking member is engaged with the first shoot bolt arm in its extended position, and an unlocked position in which the locking member is unengaged with the first shoot bolt arm; and an actuator for moving the locking member between its locked and unlocked positions when the shoot bolt arms are in their mutually extended position.

2. The lock of claim 1 wherein the locking member is slideable within the casing and yieldingly biased to remain in at least one of the locked position and the unlocked position.

3. The lock of claim 1 wherein the locking member is yieldingly biased to remain in the locked position and the unlocked position by at least one spring biased plunger.

4. The lock of claim 1 wherein the locking member is engaged in a locking slot of the first shoot bolt arm that is elongated in a direction of travel of the first shoot bolt arm.

5. The lock of claim 1 wherein the locking member is engaged in a locking slot of the first shoot bolt arm that extends entirely through the first shoot bolt arm in a direction of travel of the locking member.

6. The lock of claim 1 wherein each shoot bolt arm comprises an arm portion and a linkage, each linkage having a first end that is pivotably coupled to the driver by the corresponding pivot and an opposite second end that is pivotably coupled to the corresponding arm portion.

7. The lock of claim 6 wherein each shoot bolt arm is coupled to opposing portions of the same rotating driver.

8. The lock of claim 7 wherein the rotating driver is rotatably supported in the lock body at two different locations along the rotation axis of the driver.

9. The lock of claim 1 wherein the lock body includes at least one spindle follower that rotates with the handle and at least one biasing device that interacts with the spindle follower to maintain the handle in the first and second rest positions.

10. The lock of claim 9 wherein the at least one biasing device comprises a plurality of biasing pads having curved contact faces that engage with corresponding recesses in the spindle follower.

11. A two point lock for bi-fold windows and doors; comprising:

a central lock body;

a driver rotatably supported in the lock body at two different locations along the rotation axis of the driver, the driver including a first follower and a second follower offset from the first follower along the rotation axis, wherein opposing faces of the first follower and the second follower face one another such that a gap is located therebetween, and wherein each of the first follower and the second follower is rotatably supported at a corresponding one of the two different locations along the rotation axis;

at least one biasing pad that interacts with the driver to maintain the driver in a first rest position and a second rest position; and first and second shoot bolt arms that move in opposite directions upon rotation of the driver and are maintained in a mutually retracted position when the driver is in the first rest position and in a mutually extended position when the driver is in the second rest position, wherein each of the shoot bolt arms extends into the gap and is pivotally connected to each of the first follower and the second follower via a corresponding and respective pivot, each pivot having a first end portion pivotably supported by the first follower and a second end portion pivotably supported by the second follower.

12. The lock of claim 11 wherein the at least one biasing pad has a curved contact face that engages with at least one recess in the driver.

13. The lock of claim 11 wherein a plurality of biasing pads contact the first follower and the second follower at different locations along the rotation axis of the driver.

14. The lock of claim 11 wherein a plurality of biasing pads contact the driver at opposing radial positions.

15. The lock of claim 11 wherein the lock body includes a first set of stops which contact the driver in the first position so as to prevent further rotation of the driver in a first direction.

16. The lock of claim 15 wherein the lock body includes a second set of stops which contact the driver in the second position so as to prevent further rotation of the driver in a second direction.

17. The lock of claim 1, wherein the actuator is operated by a key.

18. The lock of claim 1, wherein the opposing members are rotationally coupled for joint rotation with one another.

19. A lock, comprising:

a central lock body comprising a casing;

a handle that is rotatable with respect to the lock body between a first rest position and a second rest position;

a rotating driver coupled to the handle for rotation therewith, the driver including a first follower and a second follower, wherein the first follower and the second follower are offset from one another along a rotational axis of the driver such that an annular gap is formed between the first follower and the second follower, and wherein each of the followers includes a first recess and a second recess;

first and second shoot bolt arms that move in opposite directions upon rotation of the handle and are maintained in a mutually retracted position when the handle is in the first rest position and in a mutually extended position when the handle is in the second rest position, wherein each shoot bolt arm includes a corresponding and respective end portion that is positioned in the annular gap such that the end portion is captured between the first follower and the second follower, wherein each of the end portions is pivotally connected to each of the drivers via a corresponding and respective pivot pin that extends between the followers, each pivot pin having a first end portion supported by the first follower and a second end portion supported by the second follower;

a biasing mechanism comprising a plurality of biasing pads including a first biasing pad and a second biasing pad, wherein each of the biasing pads includes a curved contact face;

wherein with the handle in the first rest position, the curved contact faces of the first biasing pad and the second biasing pad are engaged with the first recesses such that the biasing mechanism resists rotation of the handle from the first rest position; and wherein with the handle in the second rest position, the curved contact faces of the first biasing pad and the second biasing pad are engaged with the second recesses such that the biasing mechanism resists rotation of the handle from the second rest position.

20. The lock of claim 19, wherein the first recesses of the first follower and the second follower are aligned with one another, wherein the second recesses of the first follower and the second follower are aligned with one another, and wherein the first biasing pad and the second biasing pad are offset from one another along the rotational axis such that the first biasing pad is aligned with the first follower and the second biasing pad is aligned with the second follower.

21. The lock of claim 20, wherein each of the followers further includes a third recess diametrically opposite the first recess and a fourth recess diametrically opposite the second recess;

wherein the plurality of biasing pads further includes a third biasing pad and a fourth biasing pad, wherein the third biasing pad and the fourth biasing pad are offset from one another along the rotational axis such that the third biasing pad is aligned with the first follower and the fourth biasing pad is aligned with the second follower;

wherein with the handle in the first rest position, the curved contact faces of the third biasing pad and the fourth biasing pad are engaged with the third recesses such that the biasing mechanism resists rotation of the handle from the first rest position; and wherein with the handle in the second rest position, the curved contact faces of the third biasing pad and the fourth biasing pad are engaged with the fourth recesses such that the biasing mechanism resists rotation of the handle from the second rest position.

22. The lock of claim 19, further comprising a locking member for selectively locking the first and second shoot bolt arms in the mutually extended position.

23. The lock of claim 22, wherein the first shoot bolt arm includes a locking slot that extends entirely through the first shoot bolt arm in a direction of travel of the locking member, and wherein the locking member engages the locking slot to lock the first and second shoot bolt arms in the mutually extended position.

24. The lock of claim 19, wherein the first follower and the second follower are rotationally coupled with one another for joint rotation about the rotational axis.

25. The lock of claim 19, wherein the first follower and the second follower are of identical construction.

* * * * *